United States Patent [19]

Genovese

[11] Patent Number: 4,845,798

[45] Date of Patent: Jul. 11, 1989

[54] HEIGHT ADJUSTMENT CONTROL FOR A FLOOR POLISHING MACHINE

[75] Inventor: Vincent P. Genovese, Ft. Worth, Tex.

[73] Assignee: Southwest Manufacturers & Distributors, Inc., Fort Worth, Tex.

[21] Appl. No.: 193,128

[22] Filed: May 5, 1988

Related U.S. Application Data

[63] Continuation of Ser. No. 930,347, Nov. 12, 1986, abandoned.

[51] Int. Cl.[4] ..... A47L 11/162

[52] U.S. Cl. ..... 15/98; 51/177

[58] Field of Search ..... 15/49 R, 50 R, 98, 385, 15/354; 51/177; 280/43, 43.17, 43.2, 43.22

[56] References Cited

U.S. PATENT DOCUMENTS

| | | | |
|---|---|---|---|
| 1,210,524 | 1/1917 | Orr | 280/43.17 |
| 1,533,806 | 4/1925 | Parker | 15/354 X |
| 1,891,175 | 12/1932 | Petersen | 15/49 R |
| 2,675,246 | 4/1954 | Arones | 280/43.17 |
| 2,784,433 | 3/1957 | Verhagen | 15/49 R |
| 2,893,019 | 7/1959 | Renfroe | 280/432 |
| 2,949,619 | 8/1960 | Holt | 15/49 R |
| 4,045,041 | 8/1977 | Risser | 280/43.17 |
| 4,358,868 | 11/1982 | Cook | 51/177 |
| 4,658,459 | 4/1987 | Wood | 51/177 |

OTHER PUBLICATIONS

Catalogue pp. 218–222, Southwest Manufacturers & Distributors Inc., (1986).

*Primary Examiner*—Harvey C. Hornsby
*Assistant Examiner*—Scott J. Haugland
*Attorney, Agent, or Firm*—Charles D. Gunter, Jr.

[57] ABSTRACT

A floor polishing machine is shown having a one piece, rotationally molded base formed from a synthetic, non conductive material. The base has a pad receiving portion integrally formed of the synthetic material for receiving a polishing pad. A motor compartment is formed in the rotationally molded base to contain an electric motor used to drive the pad. A pair of transport wheels are mounted on opposite sides of the base by a fixed axle which passes transversely through the base. A pair of height adjustment wheels are mounted to opposite sides of the base by a pivoting axle which allows the pad height to be controlled.

4 Claims, 2 Drawing Sheets

HEIGHT ADJUSTMENT CONTROL FOR A FLOOR POLISHING MACHINE

This application is a continuation of application Ser. No. 930,347, filed Nov. 12, 1986, now abandoned.

BACKGROUND OF THE INVENTION

1. Cross Reference to Related Applications:

This application is related to my copending application entitled "Floor Polishing Machine", filed June 30, 1986, Ser. No. 880,301.

2. Field of the Invention

The present invention relates to electrical floor polishing devices for commercial and residential use and to a height adjustment for such devices to control the level of the polishing pad used by the device.

3. Description of the Prior Art:

Many types of electrically powered floor polishing machines are presently sold in the marketplace. These machines typically feature a base or frame of a conductive material, such as steel or aluminum, onto which is bolted an electric motor. The motor is not typically received within a recess on the base and the metallic material of the base can be dented or can corrode with time. The metallic materials of the motor and base amplify the operating noise of the machine and also increase the overall weight of the machine.

Presently available floor polishing machines do not provide a simple and convenient method for adjusting the pad level. As a result, there is no convenient way to compensate for size differentials between different pads or to adjust the pad height to allow for pad wear.

The present invention has as its object a design for a floor polisher in which the base is provided from a nonconductive material which is less susceptible to damage or corrosion than were previously known designs.

Another object of the invention is a floor polisher design featuring a base of lighter weight material which acts as a sound deadener during operation.

Another object of the invention is the provision of a height adjustment for a floor polisher which allows the pad level to be controlled by the operator to compensate for varying pad thickness and to allow for pad wear.

Another object of the invention is a floor polisher design which saves manufacturing and assembly costs.

The above as well as additional objects, features, and advantages of the invention will become apparent in the following detailed description.

SUMMARY OF THE INVENTION

The floor polishing machine of the invention features a base which is preferably rotationally formed from a synthetic, non-conductive material. The base has a pad receiving portion integrally formed of the synthetic material for receiving a polishing pad. A pair of transport wheels are mounted on opposite sides of the base by means of a fixed axle which passes transversely through the base. A motor compartment formed in the rotationally moded base has an open top, vertical sidewalls, and a bottom wall. An electric motor is received within the motor compartment with the vertical sidewalls approximately containing the motor. Drive means connect the electric motor to the pad for driving the pad to polish a floor.

A pair of height adjustment wheels are mounted on opposite sides of the base by means of a pivoting axle. Adjustment means are provided for varying the position of the pivoting axle to vary the height of the adjustment wheels and thereby raise and lower the pad with respect to the floor.

The pivoting axle includes a straight portion which passes transversely through the base in a plane parallel to the axis of the fixed axle and oppositely extending outer extents which form an angle with respect to the straight portion of the pivoting axle. The pivoting axle straight portion has an internally threaded coupling. An adjustment bolt passes through an opening in the housing to the coupling. The adjustment bolt has an externally threaded shaft which is received within the internally threaded coupling, whereby turning the adjustment bolt causes the shaft to travel within the internally threaded coupling to vary the position of the pivoting axle.

DESCRIPTION OF THE PREFERRED EMBODIMENT

Figure 1:
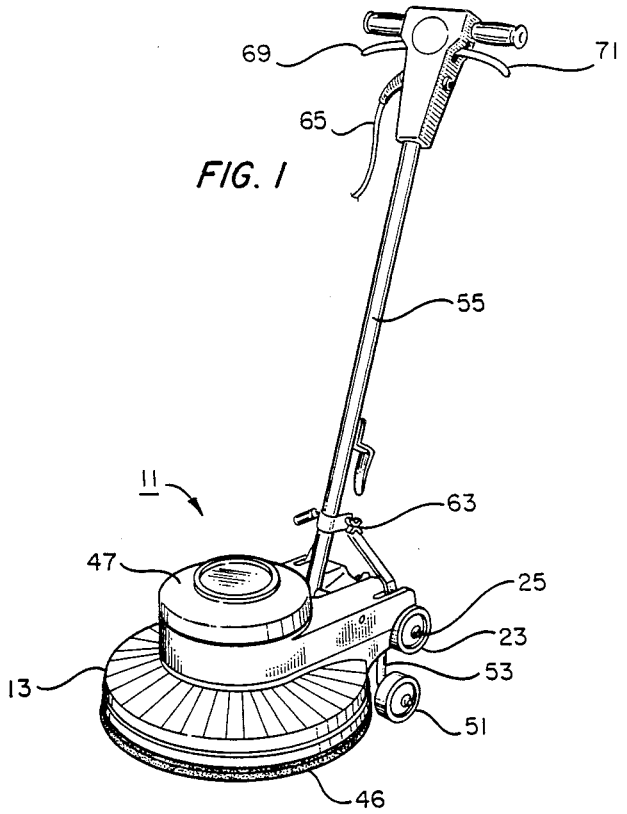
FIG. 1 is front perspective view of the floor polishing machine of the invention.

FIG. 1 shows a floor polishing machine of the invention, designated generally as 11. The floor polishing machine 11 has a one piece, rotationally molded base 13 formed from a synthetic, non-conductive material. In rotational molding, the product is formed inside a closed mold or cavity where the mold is rotated biaxially in a heating chamber. To obtain the mold rotation in two planes perpendicular to each other, a spindle is rotated on a primary axis, while the mold is rotated on a secondary axis. In the loading stage, either liquid or powdered plastic is charged into a hollow mold. The mold halves are then clamped shut and moved into an oven where the loaded mold spins biaxially.

In the oven, heat penetrates the mold causing the plastic, if it is in the powder form, to become tacky and stick to the mold surface, or if it is in the liquid form, to start to gel. Usually, the heating is done by air or by liquid of high specific heat, such as molten salt. Since the mold continues to rotate while the heating is going on, the plastic will gradually become distributed evenly on the mold cavity walls through gravitational force. As the cycle continues, the synthetic material melts completely and forms a homogeneous layer of molten plastic.

When the parts have been formed, the mold is moved to a cooling chamber where cooling is accomplished by either a cold spray of water and/or forced air or liquid circulation inside the mold. The mold continues to be rotated during the cooling cycle. Additional details on rotational molding can be found in the Plastics Engineering Handbook of the Society of Plastics, Inc., 4th Edition, Ed. J. Frados, Nostrand-Reinhold Publishers.

Figure 2:
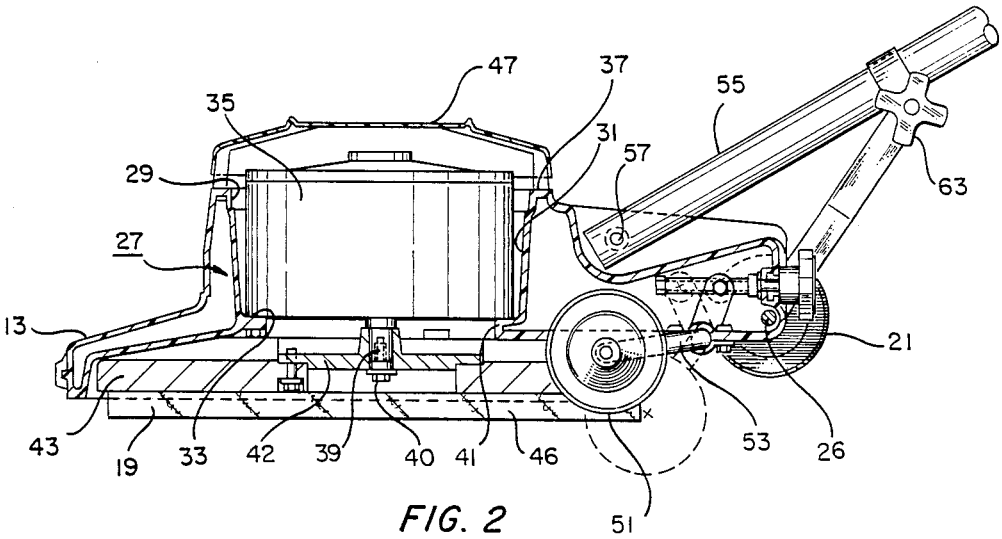
FIG. 2 is a side, partial cross-sectional view of the machine of FIG. 1.

As shown in FIG. 6, the one piece base 13 has a body portion 15 and a dome shaped pad receiving portion 17 integrally formed of the synthetic material for receiving a conventional polishing pad, as will be described. As shown in FIGS. 1 and 2, a pair of primary wheels 21,23 are mounted on opposite sides of the base 13 by means of a fixed axle 25 which passes transversely through an opening 26 (FIG. 2) in the base 13.

As best seen in FIG. 2, a generally cylindrical motor compartment (designated as 27) is formed in the rotationally molded base 13. The compartment is formed with an open top 29, vertical sidewalls 31, and a bottom wall 33. The open top 29 and vertical sidewalls 31 form a recess for receiving an electric motor 35 having an exterior which conforms to the shape of the motor compartment 27. As shown in FIGS. 1 and 2, the electric motor is received within the compartment with the vertical sidewalls 31 approximately containing the motor. An electric motor 35 of the type under consideration is commercially available from Southwest Manufacturers & Distributors, Inc. of Fort Worth, Tex., as a ½ horsepower, 115 volt, 1500 r.p.m. "pancake" style motor and has generally cylindrical exterior sidewalls which allow it to be snugly received within the motor compartment 7. The total height of the motor extends to approximately the mouth 37 of the motor compartment 27.

The motor has a driven shaft 39 (FIG. 2) which extends vertically through an opening 41 provided in the bottom wall 33 in the base. The driven shaft 39 is connected by means of a screw 40 to a drive plate 42 which, in turn, is connected to a pad holder 43, as by screws 44. The pad holder 43 receives a polishing pad 46 of the type used to polish a floor. The motor, pad holder and pad arrangement described is conventional and will be familiar to those skilled in the art.

A cap 47 of a synthetic material can be provided for covering the open top of the motor compartment 27 when the electric motor 35 is installed within the compartment, whereby the electric motor is completely contained within the motor compartment 27.

Figure 3:
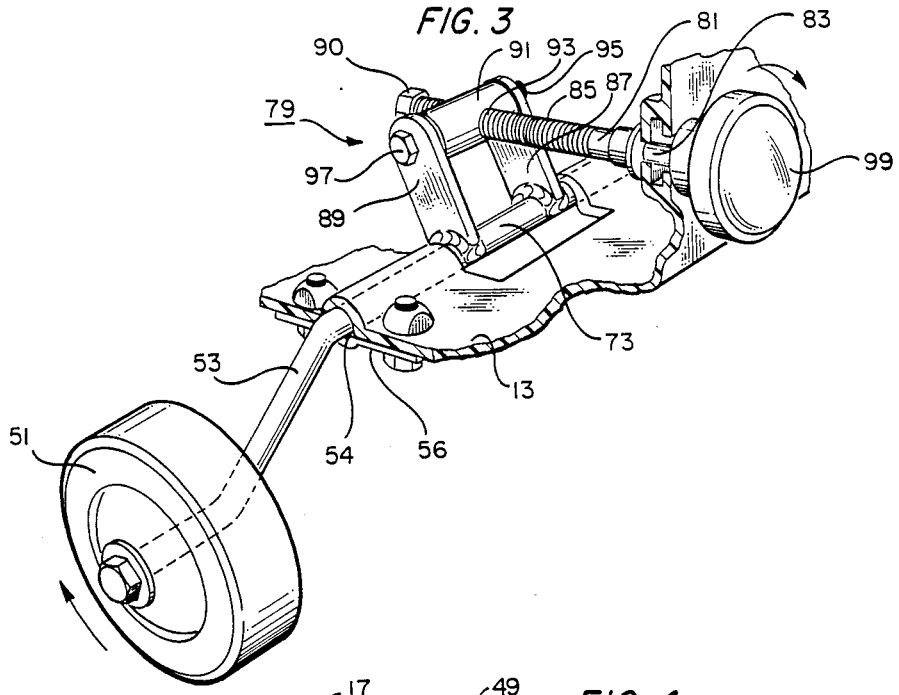
FIG. 3 is an isolated view of the height adjustment control of the machine of FIG. 1.
Figure 4:
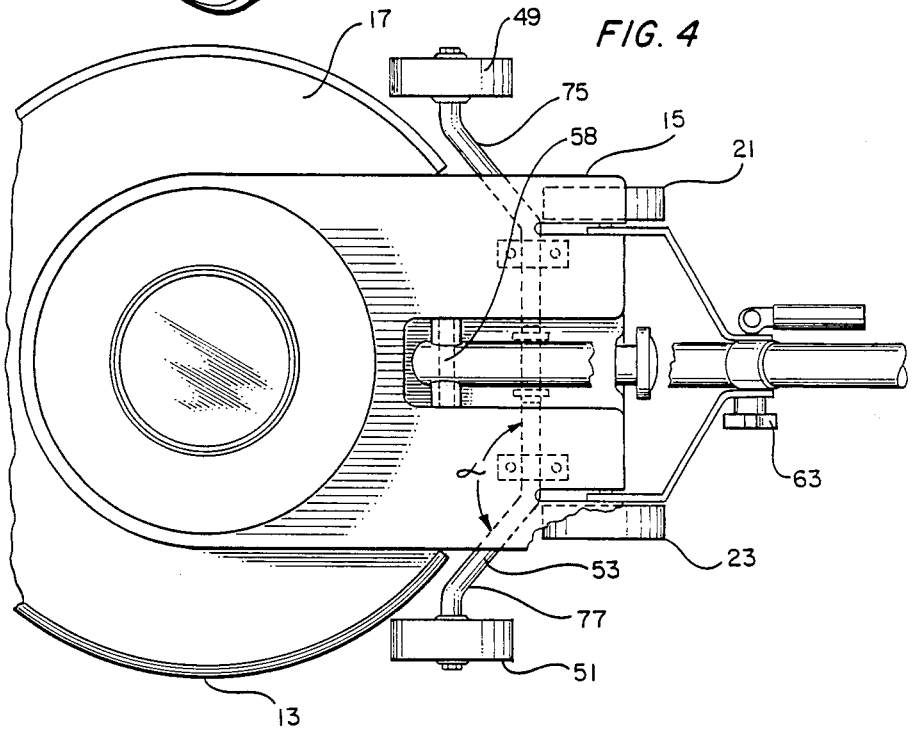
FIG. 4 is a top view of the floor polishing machine showing portions of the height adjustment control in dotted lines.

As shown in FIGS. 2 and 4, a pair of height adjustment wheels 49,51 are mounted on opposite sides of the base 13 by means of a pivoting axle 53 which passes transversely through an opening 54 (FIG. 3) provided between a wall of the base 13 and a mounting plate 56.

A handle 55 is pivotally mounted on the base 13 by a transverse bar 57 (FIG. 2) which passes through the handle 55 to form a pivot point 58( FIG. 4). An adjustable clamp 63, commercially available and known to those in the industry, can be used to position the handle 55 at different pivotal locations during use. A source of electrical current is connected by cord 65 to a control box 67 on the handle and from the control box 67 through the handle 55 to the electric motor 35. Levers 69,71 operate a conventional switch to turn the motor on and off.

The adjustment means for varying the position of the pivoting axle 53 is shown in isolated fashion in FIG. 3. The pivoting axle has a straight portion 73 which passes transversely through the base 13 in a plane parallel to the axis of the fixed axle 25. The pivoting axle 53 also has oppositely extending outer extents 75,77 which form an angle with respect to the straight portion 73 of the pivoting axle before again becoming parallel to the straight portion 73. The angle alpha in FIG. 4 is approximately 140 degrees.

The pivoting axle 53 also carries an internally threaded coupling 79. An adjustment bolt 81 passes through an opening 83 in the housing 13 to the coupling 79. The adjustment bolt has an externally threaded shaft 85 which is received within the internally threaded coupling. The coupling preferably includes a pair of spaced apart pivot ears 87,89 which extend from the straight portion 73.

A cross member 91 is rotatably mounted between the pivot ears 87,89 and is provided with an internally threaded bore 93 for receiving the threaded shaft 85 of the adjustment bolt. The cross member has a cylindrical exterior and can be provided with end openings for receiving screws 95,97. The screws 95,97 engage the pivot ears 87,89 so that the cross member is loosely held and rotatable. The length of the screws 95,97 is selected to terminate short of the shaft 85 to thereby allow the shaft 85 to pass through the cross member.

The shaft 85 is preferably provided with right hand threads which engage mating threads in the bore 93 so that turning the adjustment knob (99 in FIG. 3) clockwise causes the cross member to be pulled in the direction of the knob. This action causes the height adjustment wheels 49,51 to move in an arcuate path with respect to the pivoting axle straight portion 73 (as indicated by the arrow in FIG. 3) to lower the base 13. Turning the adjustment knob counterclockwise causes the base 13 to be raised with respect to the floor. A wing nut 90 is received on the end of the shaft 85 opposite knob 99.

An invention has been provided with several advantages. The floor polishing machine of the invention is made with a one piece rotationally molded base which is lighter in weight and less subject to damage and corrosion than metallic materials. The recessed motor compartment contains the electric motor and deadens the operating noise of the machine. The non-conductive nature of the base insures safety from electrical hazards, even when the device is being operated on wet floors. The molded base is simple in design and less expensive to manufacture than previous designs. The height adjustment feature of the new design allows pads of different thicknesses to be used and allows adjustment of the pad height to compensate for pad wear during use.

While the invention has been described in only one of its forms, it should be apparent to those skilled in the art that it is not so limited, but is susceptible to various changes and modifications without departing from the spirit thereof.

I claim:

1. A floor polishing machine for use on a horizontal surface, comprising:

a polishing pad;

a base having a pad receiving portion for receiving the polishing pad;

a fixed axle which passes transversely through the base at a selected height with respect to the plane of the horizontal surface;

a pair of transport wheels mounted to said fixed axle on opposite sides of said base;

a motor compartment formed in the base directly over the pad receiving portion and having an opening for receiving an electric motor;

an electric motor received within the motor compartment, the electric motor being directly connected to the pad for driving the pad to polish a floor;

a pivoting axle including a straight portion which is pivotally mounted to the base in a plane parallel to the axis of the fixed axle and at a selected height with respect to the plane of the horizontal surface, the pivoting axle also having oppositely extending outer extents which form approximately equal angle with respect to the pivoting axle straight portion, and wherein the pivoting axle straight portion is provided with an internally threaded coupling which is rigidly affixed to the pivoting axle;

a pair of height adjustment wheels mounted on said pivoting axle on opposite sides of the base between the transport wheels and the pad receiving portion; and an adjustment bolt passing in a plane substantially parallel to the horizontal surface through an opening provided in the rear of the base to the internally threaded coupling, the adjustment bolt having an externally threaded shaft which is received within the internally threaded coupling, wherein turning the adjustment bolt causes the shaft to travel within the internally threaded coupling to vary the position of the pivoting axle relative to the polishing pad, to adjust the position of the polishing pad relative to the horizontal surface by moving the adjustment wheels in an arcuate path with respect to the pivoting axle straight portion through a range of angular positions.

2. The floor polishing machine of claim 1, wherein the pivoting axle internally threaded coupling includes a pair of spaced apart pivot ears which extend from the straight portion of the pivoting axle, the coupling further including a cross member rotatably mounted between the pivot ears, the cross member having an internally threaded bore for receiving the threaded shaft of the adjustment bolt.

3. A floor polishing machine for use on a horizontal surface, comprising:

a polishing pad;

a one piece, rotationally molded base formed from a synthetic, non-conductive material, the base having a pad receiving portion integrally formed of the synthetic material for receiving the polishing pad;

an axle which passes transversely through the base at a selected height with respect to the plane of the horizontal surface;

a pair of transport wheels mounted to said axle on opposite sides of the base;

a motor compartment formed in the rotationally molded base directly over the pad receiving portion, the compartment being formed with an open top, vertical sidewalls, and a bottom wall;

an electric motor received within the motor compartment with the vertical sidewalls of the motor compartment approximately containing the motor, the electric motor being directly connected to the pad for driving the pad to polish a floor wherein the electric motor and the polishing pad are substantially aligned along a vertical axis substantially normal to said horizontal surface;

a pivoting axle including a straight portion which is pivotally mounted to the base in a plane parallel to the axis of the fixed axle and at a selected height with respect to the plane of the horizontal surface, the pivoting axle also having oppositely extending outer extents which form an obtuse angle with respect to the straight portion of the pivoting axle, the pivoting axle outer extents forming approximately equal angles with respect to the pivoting axle straight portion, the outer extents inclining downward and forward relative to the base, and wherein the pivoting axle straight portion is provided with an internally threaded coupling which is rigidly affixed to the pivoting axle;

a pair of height adjustment wheels mounted to said pivoting axle on opposite sides of the base between the transport wheels and the pad receiving portion; and an adjustment bolt passing in a plane substantially parallel to the horizontal surface through an opening in the rear of the base, the adjustment bolt having an externally threaded shaft which is received within the internally threaded coupling, wherein turning the adjustment bolt causes the shaft to travel within the internally threaded coupling to vary the position of the pivoting axle relative to the polishing pad and adjust the position of the polishing pad relative to the horizontal surface by moving the adjustment wheels in an arcuate path with respect to the pivoting axle straight portion through a range of angular positions as the adjustment bolt is turned from an upper position of the wheels relative to the base to a lower and more rearward position of the wheels relative to the base.

4. The floor polishing machine of claim 3 wherein the pivoting axle internally threaded coupling includes a pair of spaced apart pivot ears which extend from the straight portion of the pivoting axle, the coupling further including a cross member rotatably mounted between the pivot ears, the cross member having an internally threaded bore for receiving the threaded shaft of the adjustment bolt.

* * * * *